US006223789B1

(12) United States Patent
Koch

(10) Patent No.: US 6,223,789 B1
(45) Date of Patent: May 1, 2001

(54) REGULATION OF VAPOR PUMP VALVE

(75) Inventor: Wolfgang H. Koch, Batavia, IL (US)

(73) Assignee: Tokheim Corporation, Fort Wayne, IN (US)

( * ) Notice: Subject to any disclaimer, the term of this patent is extended or adjusted under 35 U.S.C. 154(b) by 0 days.

(21) Appl. No.: 09/339,558

(22) Filed: Jun. 24, 1999

(51) Int. Cl.[7] ..... B65B 31/00

(52) U.S. Cl. ..... 141/59; 141/51; 141/83; 141/94; 141/285; 141/290; 141/302; 95/8; 95/12; 73/23.2

(58) Field of Search ..... 141/59, 51, 83, 141/94, 285, 290, 302; 73/23.2, 31.02; 95/8, 12

(56) References Cited

U.S. PATENT DOCUMENTS

| | | | |
|---|---|---|---|
| 4,761,639 | 8/1988 | Pyke et al. . | |
| 4,764,343 | 8/1988 | Nyberg . | |
| 5,209,275 | 5/1993 | Akiba et al. . | |
| 5,255,723 | 10/1993 | Carmack et al. . | |
| 5,305,807 | 4/1994 | Healy . | |
| 5,323,817 | 6/1994 | Spalding . | |
| 5,325,896 | 7/1994 | Koch et al. . | |
| 5,332,008 | 7/1994 | Todd et al. . | |
| 5,345,979 | 9/1994 | Tucker et al. . | |
| 5,378,889 | 1/1995 | Lawrence . | |
| 5,417,256 | 5/1995 | Hartsell, Jr. et al. . | |
| 5,476,125 | 12/1995 | Mitchell . | |
| 5,484,000 | 1/1996 | Hasselmann . | |
| 5,507,325 | 4/1996 | Finlayson . | |
| 5,542,458 | 8/1996 | Payne et al. . | |
| 5,832,967 * | 11/1998 | Andersson | 141/59 |
| 5,843,212 * | 12/1998 | Nanaji | 96/4 |
| 5,988,232 * | 11/1999 | Koch et al. | 141/59 |

OTHER PUBLICATIONS

"A Fiber–Optic Sensor for Environmental Hydrocarbons", Alan Yasser & Bill Lawrence, *Sensors*, Apr. 1996, pp. 76–77.

"Voltage Readout of a Temperature–Controlled Thin Film Thickness Monitor", Juh Tzeng Lue, *Journal of Physics E: Scientific Instruments 1997*, vol. 10 p. 161–163.

"GS Oxygen Sensor"—FIGARO Product Information.

* cited by examiner

*Primary Examiner*—Timothy L. Maust
(74) *Attorney, Agent, or Firm*—Randall J. Knuth

(57) ABSTRACT

A vapor recovery system employs a sensor apparatus for determining the actual content of hydrocarbon in the effluent vapor stream. The vapor flow of the hydrocarbon effluents is regulated by controlling an adjustable valve configured at the intake or outtake side of the vapor pump in accordance with the measured hydrocarbon content. The vapor flow rate is effectively varied without requiring any change in the pump operating speed. Sensor apparatus for performing the hydrocarbon measurements include a fiber-optic sensor, an oxygen sensor, and a crystal oscillation sensor. A solenoid assembly is provided to suitably activate the valve in response to the sensor measurement data.

6 Claims, 5 Drawing Sheets

REGULATION OF VAPOR PUMP VALVE

CROSS-REFERENCE TO RELATED APPLICATIONS

This application is being filed concurrently herewith copending patent applications entitled "Vapor Recovery System Employing Oxygen Detection," U.S. patent application Ser. No. 09/134,020; Apparatus for Detecting Hydrocarbon Emissions Using Crystal Oscillators, U.S. patent application Ser. No. 09/134,116; and "Vapor Recovery System Utilizing a Fiber-Optic Sensor to Detect Hydrocarbon Emissions," U.S. patent application Ser. No. 09/134,858. The referenced copending patent applications are assigned to the same assignee as the instant application and are collectively hereby incorporated by reference herein.

BACKGROUND OF THE INVENTION

1. Field of the Invention

The present invention generally relates to vapor recovery systems for use in fuel dispenser applications, and, more particularly, to apparatus for detecting hydrocarbon emissions discharged during refueling activity and for regulating the intake flow of pumped vapors using an adjustable valve that is controlled in accordance with the sensed hydrocarbon concentration.

2. Description of the Related Art

The dispensing of fuel into the gasoline tank of a motor vehicle during refueling operations causes the displacement of volatilized fuel vapors by the incoming fuel resulting in their forcible discharge from the tank. These effluent vapor emissions must be captured or otherwise collected to prevent their escape into the surrounding environment as a contaminant. Vacuum-assisted stage II vapor recovery systems serve to recover hydrocarbon vapors displaced from vehicle fuel tanks during fuel dispensing operations. The released vapors are collected using a vapor pump that draws vapor emissions along a vapor recovery line leading to a storage facility where recovered vapors are subject to some form of treatment process such as recycling or combustion.

Optimal efficiency of the vapor recovery system results when vapor is collected at a rate that corresponds as closely as possible to the instantaneous rate of effluent vapor discharge, allowing minimal excess air to be retrieved. Conventional vacuum-assist systems employ apparatus that accomplishes such flow rate control by adjusting the operating speed of the vapor pump to create an equalization between the recovered vapor flow rate and the liquid fuel dispensing rate. These systems rely upon transducers and other sensing devices for measuring the relevant flow rates. However, this approach to flow rate equalization based on flow rate measurements and adjustments to the vapor pump operating speed may not provide the required precision needed to accurately evaluate the compositional content of the discharge environment because no direct measurement is obtained of the concentration of hydrocarbon in the effluent vapor stream. The hydrocarbon concentration is the only true measure of the suitability of an effluent vapor stream for collection and recovery.

The challenge encountered by all such vacuum-assisted vapor recovery systems involves therefore the selection of a suitable vapor monitoring device capable of dynamically sensing the presence of hydrocarbon components and generating a signal that accurately measures the detected hydrocarbon. One limitation experienced by conventional detection apparatus involves an inability to sense hydrocarbon in both its vapor and liquid state. This deficiency is pronounced when the refueling operation occurs during temperature and pressure conditions favorable to the condensation of gaseous hydrocarbon. The failure to adequately remove the hydrocarbon condensate from the detection surface of a sensing device leads to false readings and an overall corruption of the sensing measurement data, resulting in an unreliable control mechanism for regulating the vapor pump.

Implementing changes to the vapor recovery rate by adjusting the vapor pump operating speed itself presents certain disadvantages because it requires continuous variations to the cycling frequency of the vapor pump motor. This aperiodic operation may necessitate at times certain wide-ranging fluctuations in the motor frequency that could lead to excessive wear and eventually premature breakdown.

SUMMARY OF THE INVENTION

The invention comprises, in one form thereof, an apparatus for determining the actual content of hydrocarbon in the effluent vapor stream and for regulating the vapor flow of hydrocarbon effluents by controlling an adjustable valve configured at the intake side of the vapor pump in accordance with the measured hydrocarbon content. A hydrocarbon sensor is used to conduct hydrocarbon measurements. The hydrocarbon sensor may be, for example, a fiber-optic sensor, an oxygen sensor an adsorption resistor sensor, or a crystal oscillation sensor. The sensors may be disposed in front of each vapor pump or in a common vapor header, so long as the sensor is upstream of the vapor pump. A solenoid assembly is provided to activate the valve in response to the sensor measurement data. Operating conditions characterized by a low hydrocarbon or high oxygen measurement will cause the solenoid assembly to close the vapor input to the vapor pump, or the vapor output from the vapor pump, prompting the vapor pump to enter into an internal recirculation mode. The vapor flow rate is effectively varied without requiring any change in the pump operating speed.

The invention comprises, in another form thereof, a system for recovering hydrocarbon vapor effluents from a fuel storage container for use with a fuel delivery system, including a vapor transfer means, a sensor means, and a valve means. The vapor transfer means generates a vapor drawing action effective in communicating vapor between an inlet port and an outlet port thereof. The sensor means, which is disposed in effluent-detecting relationship to the fuel storage container and is upstream of the vapor transfer means, provides a measurement indicative of the hydrocarbon content in the hydrocarbon effluents. The valve means, which is disposed in vapor communicating relationship at an inlet port thereof to the fuel storage container and is disposed in vapor communicating relationship at an outlet port thereof to the inlet port of the vapor transfer means, controllably regulates the vapor flow of hydrocarbon effluents to the vapor transfer means in accordance with the hydrocarbon content measurement provided by the sensor means.

The sensor means includes, in one form thereof, a crystal oscillator means disposed for exposure to hydrocarbon effluents from the fuel storage container and operative to generate a resonant frequency signal having an oscillation frequency that is representative of a hydrocarbon content within vapors exposed thereto. The oscillation frequency exhibits a frequency shift relative to a fundamental resonant frequency that is determined by the hydrocarbon content within vapors exposed to the crystal oscillator means. The crystal oscillator means includes, in one form thereof, a resonant crystal structure including at least one portion thereof formed of a material capable of interacting with hydrocarbon and inducing the frequency shift upon occurrence of the hydrocarbon interaction. The vapor recovery system further includes a reference crystal oscillator means for generating a reference frequency signal at the fundamental resonance frequency; a mixing means for generating a beat signal representing the frequency differential between the resonant frequency signal from the crystal oscillator means and the reference frequency signal from the reference crystal oscillator means; and a means for coupling the beat signal to the valve means to effect vapor flow regulation therein.

The valve means includes, in one form thereof, an adjustable valve element and a solenoid assembly for controllably activating the valve element in accordance with the hydrocarbon content measurement provided by the sensor means. There is further provided a solenoid control signal means that is responsive to the resonant frequency signal provided by the crystal oscillator means for generating a solenoid control signal representative of the hydrocarbon content within vapors exposed to the crystal oscillator means. A means is provided for coupling the solenoid control signal to the solenoid assembly to effect control thereof. The vapor transfer means includes, in one form thereof, a vapor pump.

The vapor recovery system preferably includes a thermal applicator means for applying thermal energy to the crystal oscillator means to enable removal of hydrocarbon liquid therefrom.

The sensor means includes, in another form thereof, an oxygen sensor means for sensing an oxygen content within vapors exposed thereto, and an analysis means for determining a hydrocarbon content within the vapors exposed to the oxygen sensor means on the basis of the sensed oxygen content. There is further provided in the vapor recovery system a vapor control means for generating a flow control signal representative of the hydrocarbon content determined by the analysis means; and a means for applying the flow control signal to the valve means to effect vapor flow regulation therein.

The sensor means includes, in yet another form thereof, a communication means for conveying electromagnetic energy; a transmitter means for introducing electromagnetic energy into the communication means; a receiver means for detecting electromagnetic energy propagating through the communication means; and a hydrocarbon detection and actuation means for sufficiently mechanically engaging the communication means in response to the presence of hydrocarbon sensed by the hydrocarbon detection and actuation means to induce a change in the transmittance thereof. The change in transmittance of the communication means is representative of the concentration of hydrocarbon sensed by the hydrocarbon detection and actuation means. A thermal applicator means is further provided for applying thermal energy to the hydrocarbon detection and actuation means to enable removal of hydrocarbon liquid therefrom.

The communication means includes, in one form thereof, an optical fiber. The hydrocarbon detection and actuation means includes, in one form thereof, a sensing structure that is mechanically coupled to at least a portion of the optical fiber and is reactively sensitive to the presence of hydrocarbon in at least one of a liquid state and a vapor state for absorbing hydrocarbon upon the presence thereof and expanding in response thereto. The sensing structure is characterized such that the absorption of hydrocarbon therein and the expansion thereof is repeatably substantially reversible. A thermal applicator means is provided for applying thermal energy to the sensing structure to enable hydrocarbon desorption therein and contraction thereof from a hydrocarbon-induced expansive state. The transmitter means and receiver means respectively include, in one form thereof, a laser and optical detector.

The vapor recovery system further includes a translation means for providing a measure of the change in transmittance of the communication means using a measure of the energy detected by the receiver means; a control means for generating a flow control signal representative of the transmittance change measurement provided by the translation means; and a coupling means for applying the flow control signal to the valve means to effect vapor flow regulation therein. The measure provided by the translation means of the change in transmittance of the communication means is representative of the concentration of hydrocarbon interacting with the sensing structure to cause expansion thereof. The valve means includes a solenoid-activatable valve system.

The communication means includes, in another form thereof, a plurality of optical fiber sections arranged in seriatim and each disposed in light-communicative relationship with any adjacent ones of the plural optical fiber sections and displaced relative to the adjacent optical fiber sections by a coupling region therebetween.

The hydrocarbon detection and actuation means includes a sensing structure that is mechanically coupled to at least a portion of one of the plural optical fiber sections and is reactively sensitive to the presence of hydrocarbon in at least one of a liquid state and a vapor state for absorbing hydrocarbon upon the presence thereof and expanding in response thereto. The expansion of the sensing structure effects, in one form thereof, a microbending of the one optical fiber section. The expansion effects, in another form thereof, a relative transverse displacement between the one optical fiber section and others of the optical fiber sections adjacent thereto.

The valve means includes an adjustable valve element and a solenoid assembly for controllably activating the valve element in accordance with the hydrocarbon content measurement provided by the sensor means. There is further provided a solenoid control signal means for generating a solenoid control signal representative of the hydrocarbon content sensed by the hydrocarbon detection and actuation means and indicated by the change in transmittance of the communication means; and a means for applying the solenoid control signal to the solenoid assembly to effect control thereof.

The invention comprises, in another form thereof, a system for recovering hydrocarbon effluents from a fuel storage container for use with a fuel delivery system, including a vapor collection means, a sensor means, and a flow rate adjustment means. The vapor collection means collects the hydrocarbon effluents from the container. The sensor means, which is disposed in effluent-detecting relationship to the fuel storage container and is upstream of the vapor collection means, provides a measurement indicative of the hydrocarbon content in the hydrocarbon effluents. The flow rate adjustment means controls the collection of hydrocarbon effluents by the vapor collection means by controllably regulating the flow of hydrocarbon effluents thereto as a function of the hydrocarbon content measurement provided by the sensor means.

The sensor means includes, in one form thereof, a crystal oscillator means disposed for exposure to hydrocarbon effluents from the fuel storage container and operative to generate a resonant frequency signal exhibiting a shift from a fundamental resonance frequency according to a hydrocarbon content within vapors exposed thereto. The crystal oscillator means includes, in one form thereof, a resonant crystal structure including at least one portion thereof formed of a material capable of interacting with hydrocarbon and inducing the frequency shift. The flow rate adjustment means includes, in one form thereof, an adjustable valve element and a solenoid assembly for controllably activating the valve element in accordance with a measure of the frequency shift exhibited by the resonant frequency signal. The vapor collection means includes a vapor pump. A thermal applicator means is provided for applying thermal energy to the crystal oscillator means to enable removal of hydrocarbon liquid therefrom.

The sensor means includes, in another form thereof, an oxygen detection means for sensing an oxygen content within vapors exposed thereto; and a derivation means for deriving a measure of the hydrocarbon content from the oxygen content sensed by the oxygen detection means and for generating a signal representative thereof. The valve means includes an adjustable valve element and a solenoid assembly for controllably activating the valve element in accordance with the measure of hydrocarbon content derived by the derivation means.

The sensor means includes, in yet another form thereof, an optical communications channel; a laser means optically coupled to the optical communications channel; a detection means for detecting energy transmitted along the optical communications channel; and a hydrocarbon detection and actuation means for sensing the presence of hydrocarbon and inducing a change in the transmittance of the optical communications channel by developing a sufficient coupling engagement therewith in response to and in accordance with the sensing of hydrocarbon.

The optical communications channel includes, in one form thereof, an optical fiber. The hydrocarbon detection and actuation means includes a sensing structure that is mechanically coupled to at least a portion of the optical fiber and is reactively sensitive to the presence of hydrocarbon in at least one of a liquid state and a vapor state for absorbing hydrocarbon upon the presence thereof and expanding in response thereto to sufficiently engage the optical fiber and effect a microbend therein. The flow rate adjustment means includes an adjustable valve element and a solenoid assembly for controllably activating the valve element in accordance with a measure of the change in transmittance of the optical fiber as induced by the sensing structure responding to the presence of hydrocarbon.

The optical communications channel includes, in another form thereof, a plurality of optical fiber sections arranged in seriatim and each disposed in light-communicative relationship with any adjacent ones of the plural optical fiber sections and displaced relative to the adjacent optical fiber sections by a coupling region therebetween. The hydrocarbon detection and actuation means include a sensing structure that is mechanically coupled to at least a portion of one of the plural optical fiber sections and is reactively sensitive to the presence of hydrocarbon in at least one of a liquid state and a vapor state for absorbing hydrocarbon upon the presence thereof and expanding in response thereto. The expansion of the sensing structure effects, in one form thereof, a microbending of the one optical fiber section, and effects, in another form thereof, a relative transverse displacement between the one optical fiber section and others of the optical fiber sections adjacent thereto. The flow rate adjustment means includes an adjustable valve element and a solenoid assembly for controllably activating the valve element in accordance with a measure of the change in transmittance of the serial arrangement of plural optical fiber sections as induced by the sensing structure responding to the presence of hydrocarbon.

The invention comprises, in yet another form thereof, a system for recovering hydrocarbon effluents from a fuel storage container for use with a fuel delivery system, including a means for providing a vapor recovery pathway; a vapor pump; a resonant structure having a characteristic fundamental resonance frequency; an adjustable valve system; and a solenoid assembly. The vapor pump is operative to develop a pumping action effective in drawing hydrocarbon effluents along the vapor recovery pathway. The resonant structure is disposed for exposure to the hydrocarbon effluents and is adapted to enable an interactivity with hydrocarbon that is effective in producing a shift in resonance frequency from the fundamental resonance frequency according to the concentration of hydrocarbon participating in the interaction. The adjustable valve system is disposed at a vapor intake side of the vapor pump for controllably regulating the flow of hydrocarbon effluents thereto. The solenoid assembly is operative to effect control of the vapor flow regulation performed by the adjustable valve system in accordance with a measure of the shift in resonance frequency associated with the resonant structure.

The resonant structure includes, in one form thereof, a crystal oscillator. The resonant structure preferably includes at least one portion thereof formed of a material having an affinity for hydrocarbon accretion. This affinity for hydrocarbon accretion is defined, in one form thereof, by an activity of reversible absorption, and defined, in another form thereof, by an activity of reversible adsorption.

The invention comprises, in yet another form thereof, a system for recovering hydrocarbon effluents from a fuel storage container for use with a fuel delivery system, including a means for providing a vapor recovery pathway; a vapor pump; an oxygen sensor; a derivation means for determining hydrocarbon content; an adjustable valve system; and a solenoid assembly. The vapor pump is operative to develop a pumping action effective in drawing hydrocarbon effluents along the vapor recovery pathway. The oxygen sensor, which is disposed for exposure to the hydrocarbon effluents, senses an oxygen content within vapors exposed thereto. The derivation means determines a hydrocarbon content within vapors exposed to the oxygen sensor based on the sensed oxygen content provided by the oxygen sensor. The adjustable valve system is disposed at a vapor intake or outtake side of the vapor pump for controllably regulating the flow of hydrocarbon effluents thereto or therefrom. The solenoid assembly is operative to effect control of the vapor flow regulation performed by the adjustable valve system in accordance with the hydrocarbon content determined by the derivation means.

The invention comprises, in still yet another form thereof, a system for recovering hydrocarbon effluents from a fuel storage container for use with a fuel delivery system, including a means for providing a vapor recovery pathway; a vapor pump; an optical fiber; a transceiver means; a sensing structure disposed for exposure to the hydrocarbon effluents; an adjustable valve system; and a solenoid assembly. The vapor pump is operative to develop a pumping action effective in drawing hydrocarbon effluents along the vapor recovery pathway. The transceiver means transmits electromagnetic energy into the optical fiber and receives electromagnetic energy propagating therethrough. The sensing structure is mechanically coupled to at least a portion of the optical fiber and is reactively sensitive to the presence of hydrocarbon in at least one of a liquid state and a vapor state for absorbing hydrocarbon upon the presence thereof and expanding in response thereto to sufficiently engage the optical fiber and induce a change in the transmittance thereof. The adjustable valve system is disposed at a vapor intake side of the vapor pump for controllably regulating the flow of hydrocarbon effluents thereto. The solenoid assembly is operative to effect control of the vapor flow regulation performed by the adjustable valve system in accordance with a measure of the change in transmittance of the optical fiber as induced by engagement of the sensing structure therewith.

The system further includes a translation means for providing a measure of the change in transmittance of the optical fiber using a measure of the energy received by the transceiver means; a control means for generating a flow control signal representative of the transmittance change measurement; and a coupling means for applying the flow control signal to the solenoid assembly to effect control thereof. The transceiver means includes, in one form thereof, a laser and an optical detector.

One advantage of the present invention is that no change in vapor pump operating speed is needed to effect a change in the flow recovery rate. Additionally, no control of vapor pump speed is necessary since once the pump inlet or outlet is closed or restricted, the vapor pump will recirculate.

Another advantage of the present invention is that the discharge environment is monitored to provide actual measurements of the hydrocarbon concentration by utilizing sensors that directly detect the presence of hydrocarbon.

The sensor of the present invention can be located anywhere between the nozzle and vapor pump, but must be upstream of the vapor pump. The preferred location is adjacent the vapor header, upstream of the vapor pump. The valve actuation means, such as a solenoid must be located downstream from the sensor, but may be at the pump vapor inlet or outlet.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
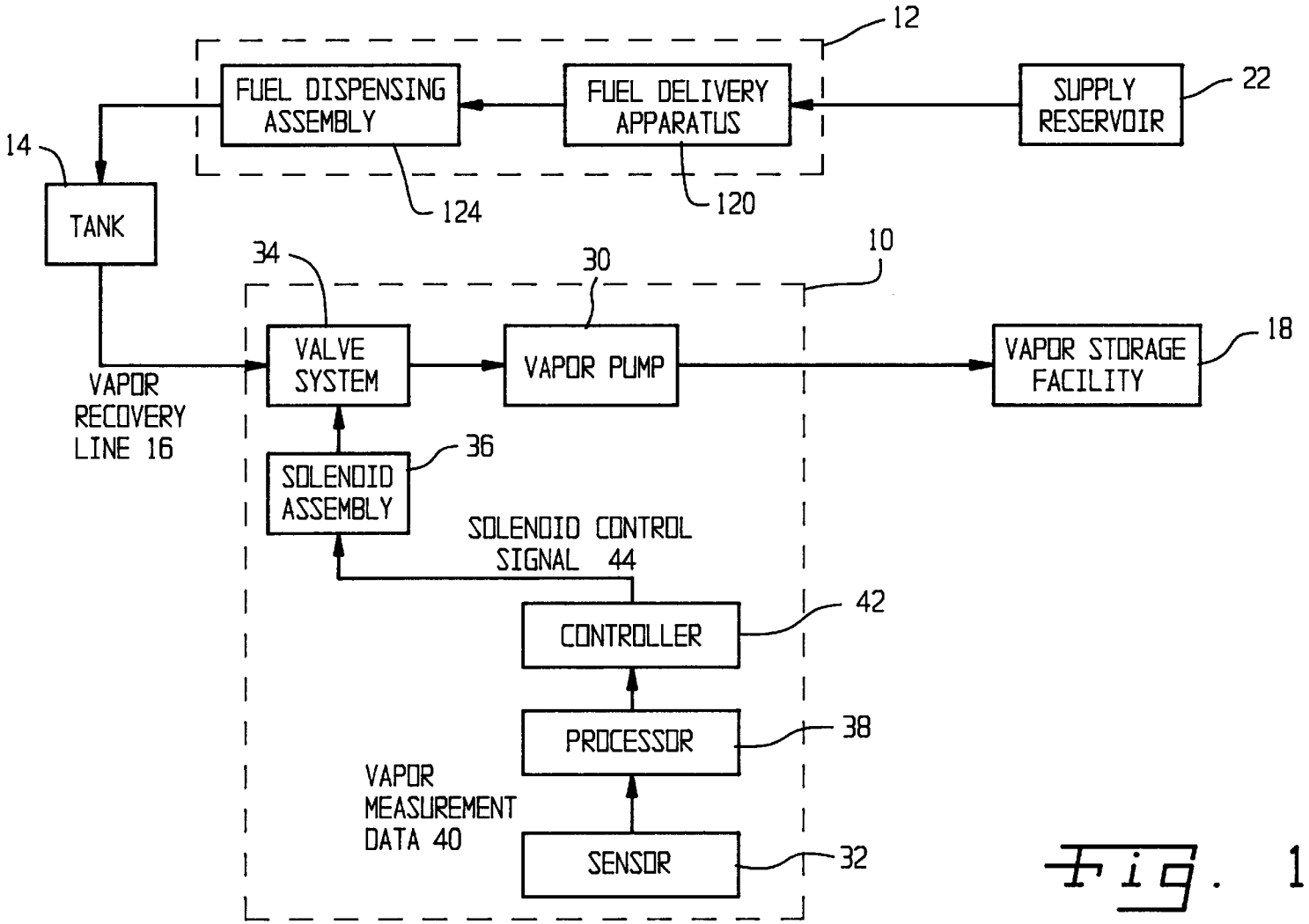
FIG. 1 is a block diagram illustration of a vapor recovery system adapted for use with a fuel dispensing apparatus according to the present invention.

Corresponding reference characters indicate corresponding parts throughout the several views. The exemplification set forth herein illustrates one preferred embodiment of the invention, in one form thereof, and such exemplification is not to be construed as limiting the scope of the invention in any manner.

DETAILED DESCRIPTION OF THE INVENTION

Referring to FIG. 1, there is shown a block diagram illustrating a vapor recovery system 10 according to the present invention, which is adapted for use with a fuel delivery system 12 and is effective in controllably routing hydrocarbon effluents discharged from tank 14 along vapor recovery line 16 to a vapor storage facility 18. The fuel delivery system 12 includes a fuel delivery apparatus 20 operative to pump liquid fuel from supply reservoir 22 and deliver the retrieved fuel to a fuel dispensing assembly 24 adapted to dispense the fuel into tank 14. For automotive applications, the fuel dispensing assembly 24 will preferably be configured in the form of a nozzle member having a dispensing portion that is insertable, at least in part, into a filler neck defining the refueling inlet passageway of tank 14.

Fuel delivery system 12 is of conventional construction based upon any one of a variety of dispenser configurations know to those skilled in the art and possessing a general functionality involving the delivery of liquid fuel to a fuel containment vessel represented by tank 14. Accordingly, any particular implementation of system 12 disclosed herein should not serve as a limitation of the present invention but instead is set forth herein for illustrative purposes only.

Vapor recovery system 10 includes a vapor pump 30 for drawing effluent vapors away from tank 14; a sensor 32 for measuring the concentration of hydrocarbon in the effluent vapors; and a valve apparatus comprised of valve system 34 disposed at a vapor intake side of pump 30 and solenoid assembly 36 for controllably regulating the vapor flow of hydrocarbon effluents to vapor pump 30 in accordance with the hydrocarbon concentration measurement provided by sensor 32. A processor 38 is provided to process the vapor measurement data 40 generated by sensor 32 and supply a signal representative of the hydrocarbon content measurement. A controller 42 is provided to generate a control signal 44 suitable for controlling solenoid assembly 36 based on the hydrocarbon measurement signal supplied by processor 38.

As will be discussed below in greater detail with reference to FIGS. 3–5, sensor 32 is implementable in a variety of embodiments all preferably configured to obtain a measurement of the hydrocarbon content with vapors exposed thereto. The measurement strategy involves directly monitoring the vapor effluent stream to detect the presence of either hydrocarbon or oxygen in the vapor effluents and provide a measure of the concentration of detected hydrocarbon or oxygen.

Vapor pump 30 functions broadly to generate a vacuum or aspirating action that induces vapor emissions discharged from tank 14 to be drawn thereto and transferred to vapor storage facility 18. The vapor drawing action is facilitated by preferably disposing vapor pump 30 within a vapor recovery passageway represented by vapor recovery line 16, which may correspond, for example, to an annular conduit concentrically disposed around the liquid fuel line. The vapor recovery passageway is characterized by its accessibility to the vapor effluents emanating from tank 14. It should be apparent to those skilled in the art that any type of vapor recovery arrangement may be adapted for use in conjunction with the present invention, including, for example, a vapor pipe traversing the interior of the fueling hose.

Valve system 34 includes an adjustable valve element integrally coupled to the vapor intake side of vapor pump 30 and disposed in vapor communicating relationship therewith. Vapor system 34 corresponds broadly to any type of mechanical device or structure by which the flow of gas applied thereto may be adjustably started, stopped, or regulated by a movable part therein (e.g., a controllable shutter member) that opens, shuts, or partially obstructs a passageway or opening therethrough. The movable part associated with the valve element is preferably activatable through the use of an electrical control signal applied thereto. Solenoid assembly 36 is of conventional construction and is disposed in coupling relationship to valve system 34, namely to the electrical contact thereof enabling activation of the movable valve part. Valve system 34 and solenoid assembly 36 are preferably packaged into a single modular unit.

During operation, sensor 32 generates measurement data 40 indicative of the concentration of hydrocarbon contained within the vapor effluents exposed to the vapor-detecting region of sensor 32. After suitable processing by processor 38 and conversion by controller 42, the vapor measurement data 40 is presented to solenoid assembly 36 in the form of a solenoid control signal 44 applied thereto and representative of the hydrocarbon concentration detected by sensor 32. Solenoid assembly 36 responds by issuing a control command to valve system 34 that effects proper control of the vapor flow regulation performed therein.

By way of illustration and not in limitation, if sensor 32 detects a low hydrocarbon level (which may also appear in the form of a high oxygen concentration level also detected by sensor 32 in one embodiment thereof), a solenoid control signal indicating such a condition will trigger solenoid assembly 36 to close or reduce the vapor inlet to vapor pump 30 by making the appropriate adjustments to the flow regulating activity of valve system 34. Substantially reducing a vapor flow into the vapor intake end of vapor pump 30 causes the pump to switch into a non-pumping mode characterized by internal recirculation, allowing the pump to continue running until valve system 34 is prompted to reopen or enlarge and begin readmitting a vapor flow into the vapor intake end of pump 30.

Processor 38 functions broadly to evaluate the hydrocarbon concentration measurement data and determine if any change is needed in the vapor recovery flow rate through controllable adjustments to valve system 34. Controller 42 implements the flow regulation decision provided by processor 38 by generating the appropriate enabling solenoid control signal.

Figure 2:
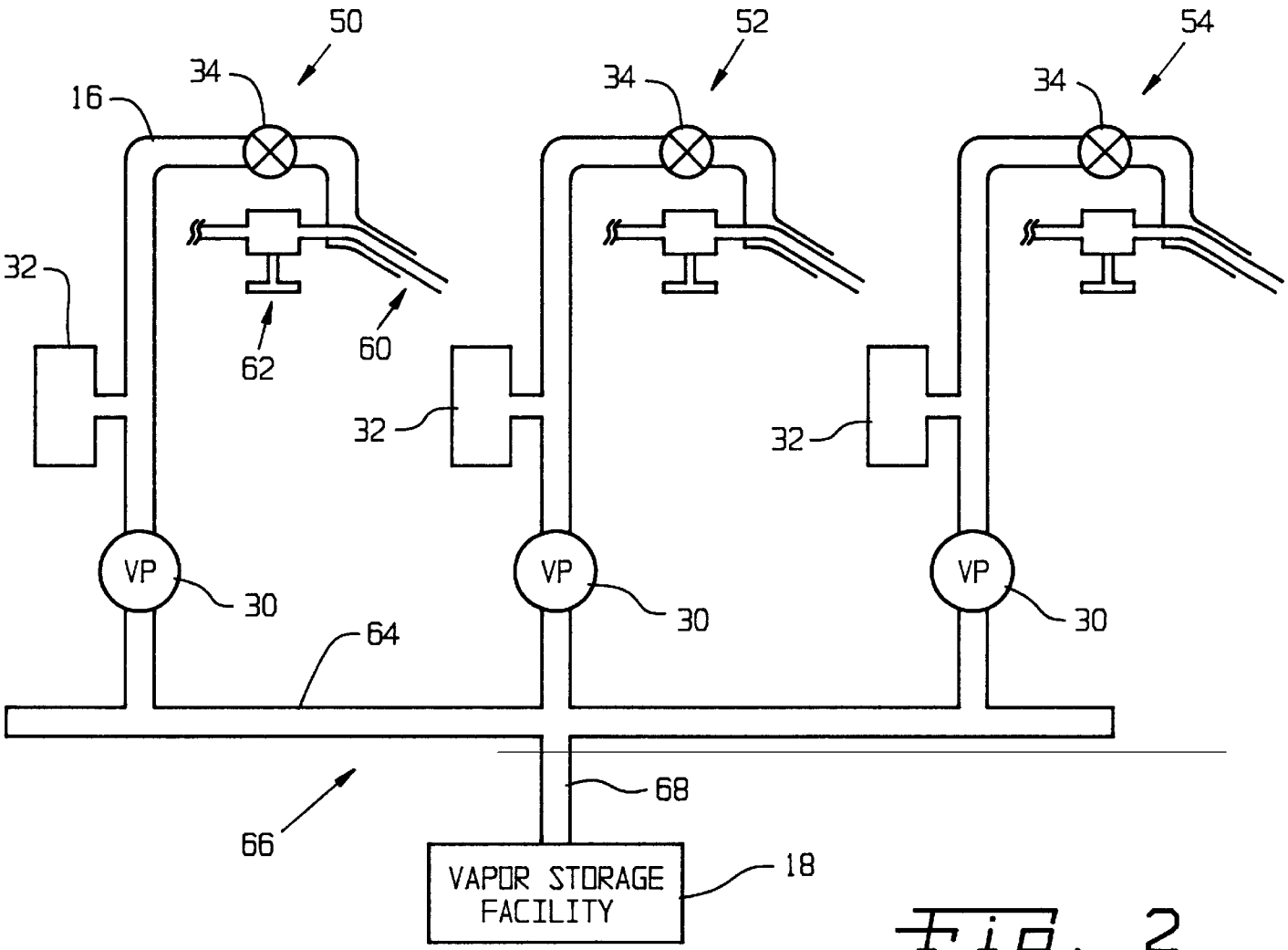
FIG. 2 is a schematic diagram depicting an illustrative configuration of the vapor recovery system of FIG. 1.

Referring to FIG. 2, there is shown a schematic diagram for illustrating a configuration of discrete fuel dispensing and vapor recovery apparatus 50, 52, and 54 in order to represent how the vapor recovery system 10 of FIG. 1 could be installed in a typical fueling station. Fuel is dispensed through a nozzle spout 60 coupled to a lever-actuated fuel dispenser 62, shown in partial diagrammatic view for illustrative purposes only. The vapor recovery line 16 shown in the form of a conduit passageway surrounds an upper portion of nozzle spout 60 to facilitate proximal access to vapors displaced from the tank (not shown) during refueling.

The recovered vapors are drawn through line 16 by vapor pump 30 disposed downstream in the conduit passageway. Valve system 34 is properly disposed within recovery line 16 to enable the regulation of vapors flowing therethrough. Sensor 32 is suitably disposed relative to vapor recovery line 16 to establish a vapor communicative relationship therewith allowing recovered effluent vapors to access the detection area of sensor 32. As shown, sensor 32 is disposed upstream of vapor pump 30. The vapor header 64 forms part of a manifold configuration 66 that couples the individual vapor recovery lines 16 to vapor storage facility 18 through common vapor head 64 and common manifold output line 68.

Figure 3:
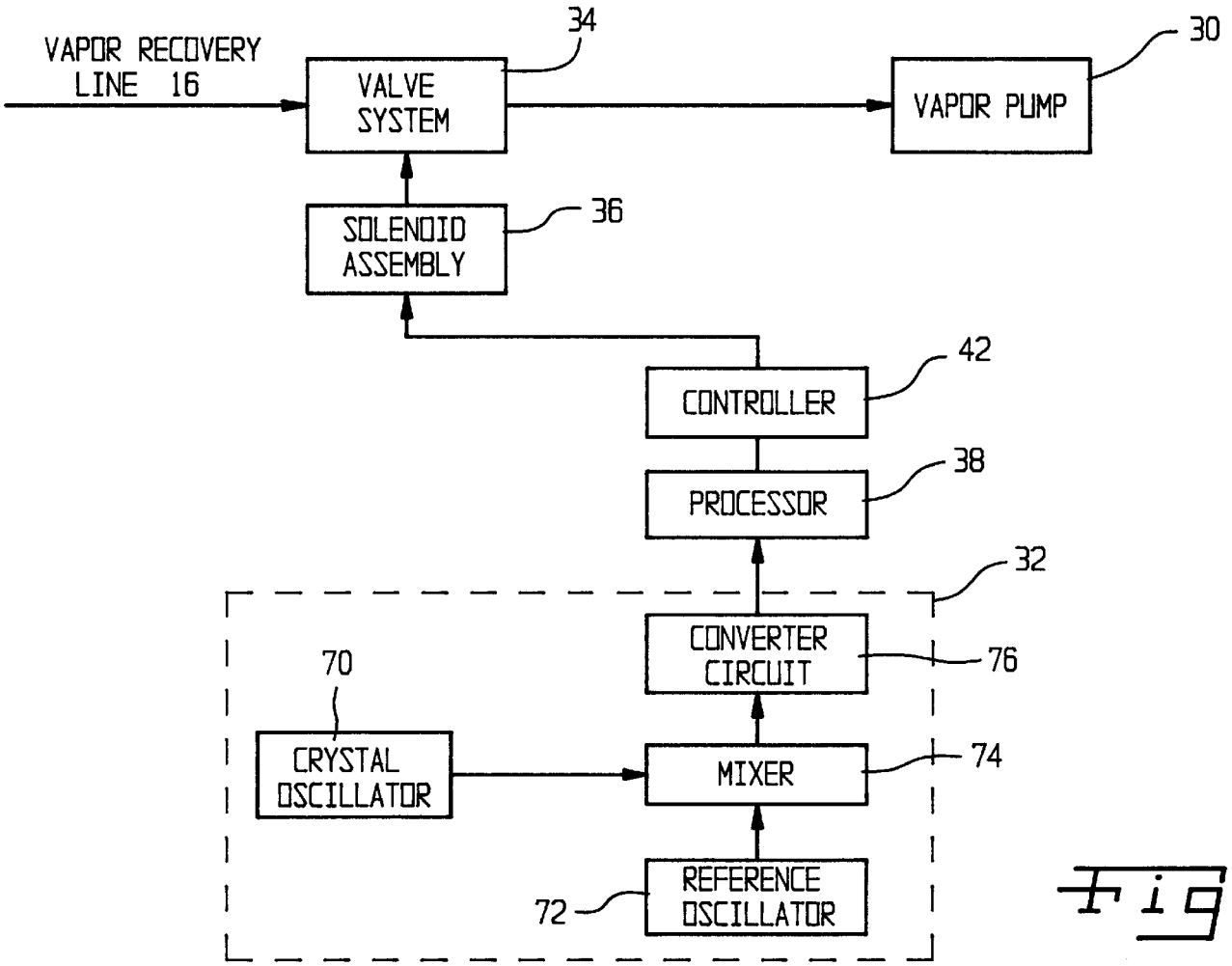
FIG. 3 is a block diagram illustration of a crystal oscillator sensing apparatus configured for use in the vapor recovery system of FIG. 1, according to one embodiment of the present invention.

Referring to FIG. 3, there is shown a block diagram illustration of the vapor recovery system 10 of FIG. 1 wherein sensor 32 is based on a crystal oscillator sensor apparatus according to one embodiment of the present invention. The illustrated crystal oscillator sensor apparatus includes a crystal oscillator 70 formed of a resonant structure characterized by a fundamental resonance frequency and adapted to interact with hydrocarbon in the presence thereof to develop a shift in oscillation frequency determined by the concentration of hydrocarbon interacting therewith. A reference oscillator 72 is provided for generating a reference frequency signal having a frequency of oscillation corresponding to the fundamental resonant frequency of crystal oscillator 70. Mixer 74 performs a frequency multiplication operation involving the frequency-shifted oscillation signal provided by crystal oscillator 70 and the fundamental resonance frequency signal provided by reference oscillator 72 to produce a beat frequency signal representing the frequency shift induced in crystal oscillator 70. Converter circuit 76 converts the beat frequency signal into a control signal representative of the frequency shift.

The frequency shift control signal provided by converter circuit 76 is conditioned by processor 38 and controller 42 and applied to valve system 34 via solenoid assembly 36 to effect vapor flow regulation therein according to the frequency shift. In particular, processor 38 determines what amount of vapor flow regulation is needed (if any) through controllable adjustments to valve system 34. This determination is based upon the frequency shift measurement. Controller 42 implements the flow regulation decision by generating the appropriate enabling solenoid control signal.

It is known that any type of film deposition on any of the major resonant surfaces of a piezoelectric quartz crystal induces a change in the frequency of oscillation of the crystal from its fundamental resonance frequency. Detection of the frequency shift therefore provides a basis for then determining the actual amount of film deposition that occurred during the measurement interval corresponding to the observed frequency shift. This phenomenon is described by J. T. Lue in "Voltage readout of a temperature-controlled thin film thickness monitor," Journal of Physics E: Scientific Instruments, vol. 10, pp. 161–163 (1977), incorporated herein by reference.

In accordance with one aspect of the present invention, a film of hydrocarbon-sensitive material is suitably deposited on a resonant crystal to define a contact structure that is adapted for contactable exposure with vapor emissions discharged from the fuel tank. The resulting coated resonant structure constitutes crystal oscillator 70, characterized in operation by a respective fundamental resonant frequency. The deposition material defines a substance having a certain affinity for hydrocarbon that is capable of sustaining a sufficient interaction with hydrocarbon to enable hydrocarbon to become physically associated with the coating material in a type of mass accretion process. For example, the interaction may involve such phenomenon as reversible absorption and adsorption. The crystal coating material is preferably selected to be able to accommodate interaction with both gaseous and liquid condensate forms of hydrocarbon. For this purpose, a thermal applicator is provided in heat-exchange relationship to crystal oscillator 70 to apply thermal energy to the deposition area and enable removal of liquid condensate therefrom.

During operation, crystal oscillator 70 becomes exposed to effluent vapors and exhibits a shift in its oscillation frequency from the fundamental resonance frequency in response to the interaction of hydrocarbon with the hydrocarbon-sensitive coating layer. The extent of frequency shift is determined by the concentration of hydrocarbon within the vapor emissions that are brought into intimate contact with the hydrocarbon-sensitive coating layer. The frequency shift is therefore representative of the amount of hydrocarbon interacting with the coating layer of crystal oscillator 70 and hence provides a measure of the hydrocarbon concentration in the emissions environment. Operational adjustments to valve system 34 are predicated upon a control signal representation of the hydrocarbon-induced frequency shift demonstrated in crystal oscillator 70.

The illustrated crystal oscillator sensor apparatus is described more fully in the aforecited copending application entitled "Apparatus for Detecting Hydrocarbon Emissions Using Crystal Oscillators," U.S. patent application Ser. No. 09/134,116.

Figure 4:
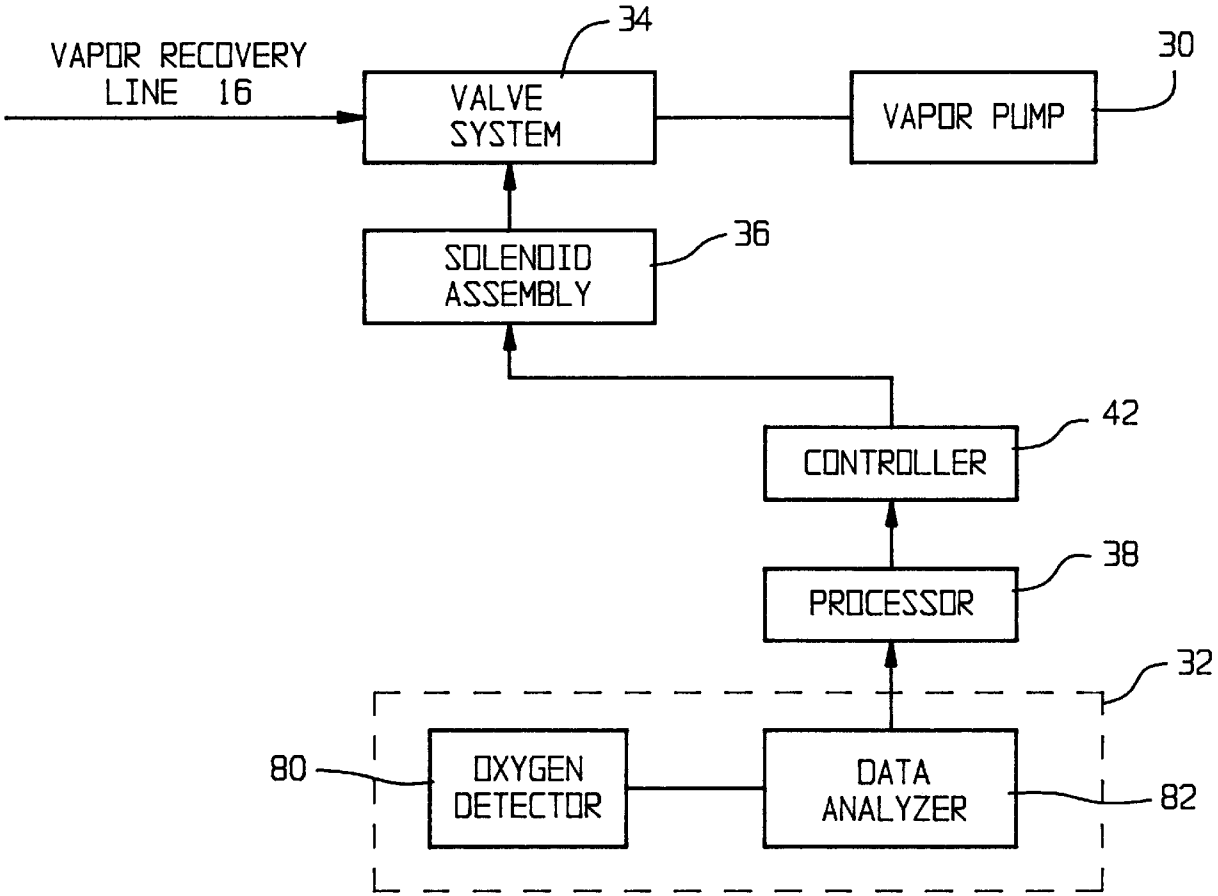
FIG. 4 is a block diagram illustration of an oxygen detection apparatus configured for use in the vapor recovery system of FIG. 1, according to another embodiment of the present invention.

Referring to FIG. 4, there is shown a block diagram illustration of the vapor recovery system 10 of FIG. 1 wherein sensor 32 is based on an oxygen detection apparatus according to another embodiment of the present invention. The illustrated oxygen detection apparatus includes an oxygen detector 80 disposed in vapor-sensing relationship to the fuel tank for sensing the presence of oxygen, and further includes a data analyzer 82 for deriving a hydrocarbon content within the effluent vapors based on the sensed oxygen content provided by oxygen detector 80.

Oxygen detector 80 monitors the vapor emissions environment and generates detection signals indicating the concentration level of oxygen in the monitored environment. In particular, oxygen detector 80 senses an oxygen content within vapors exposed thereto and hence provides a direct measurement of the oxygen concentration. Any type of suitable oxygen sensor known to those skilled in the art may be used, such as the Figaro GS oxygen sensor that generates an electrical current proportional to the oxygen concentration in the gas mixture to be analyzed. The change in output voltage across a resistor through which the current flows is representative of the oxygen concentration.

One characteristic of the emissions environment is that the presence of fuel hydrocarbons reduces the available amount of oxygen in a given air sample. Accordingly, the direct measurement of oxygen concentration as provided by oxygen detector 80 is a sufficient basis from which the hydrocarbon concentration can be derived. This indirect measurement of hydrocarbon is a reliable indicator of the hydrocarbon concentration since it is known that variations in the hydrocarbon concentration will directly influence the oxygen concentration. Data analyzer 82 functions to derive the hydrocarbon concentration from the oxygen sensing data provided by oxygen detector 80. Processor 38 evaluates the hydrocarbon concentration provided by data analyzer 82 to determine what course of action is needed regarding any required adjustments to the flow regulation activity performed by valve system 34 in conjunction with solenoid assembly 36.

The illustrated oxygen detection apparatus is described more fully in the aforecited copending application entitled "Vapor Recovery System Employing Oxygen Detection," U.S. patent application Ser. No. 09/134,020.

Figure 5:
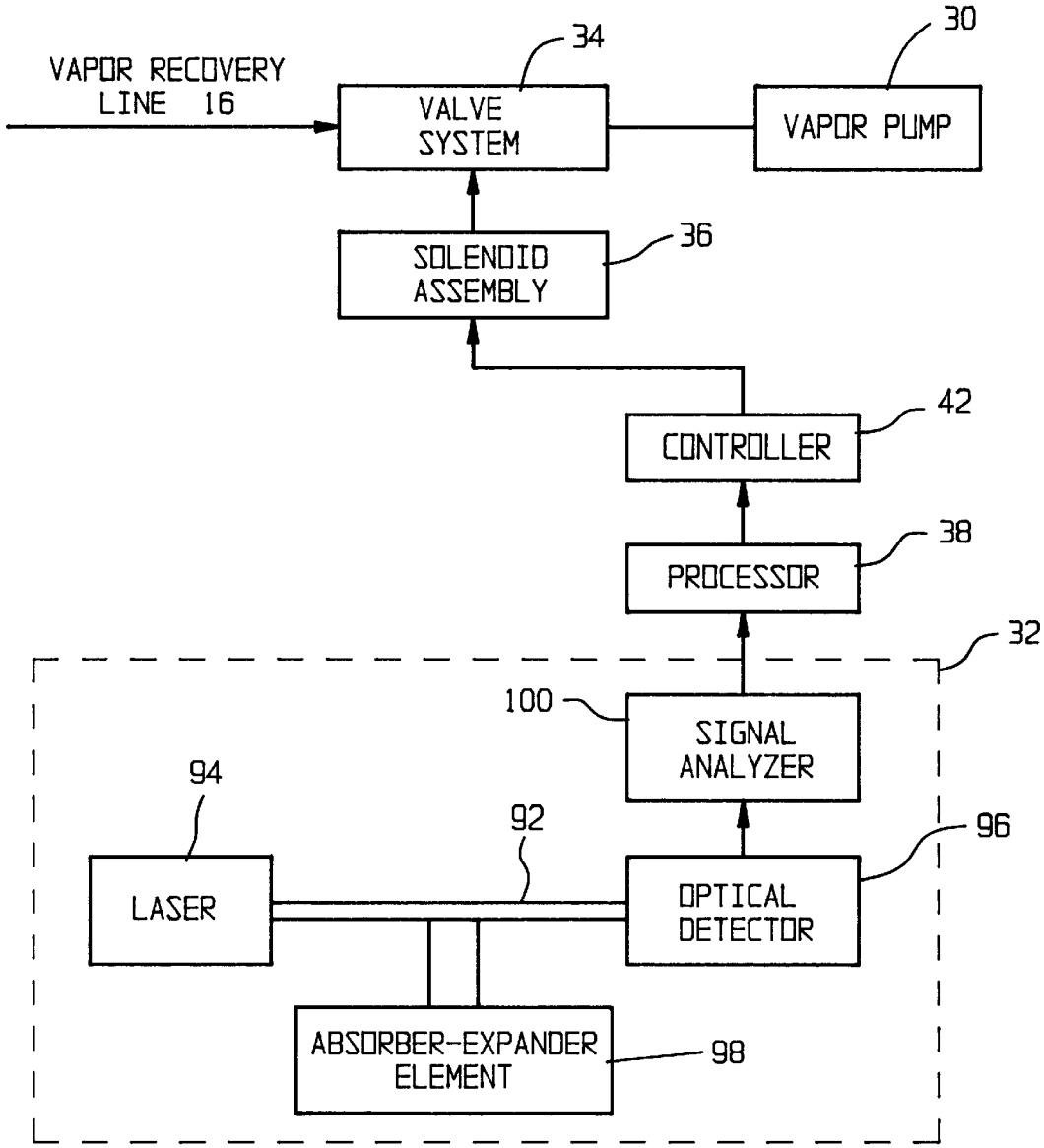
FIG. 5 is a block diagram illustration of a fiber-optic sensor apparatus configured for use in the vapor recovery system of FIG. 1, according to yet another embodiment of the present invention.

Referring to FIG. 5, there is shown a block diagram illustration of the vapor recovery system 10 of FIG. 1 wherein sensor 32 is based on a fiber-optic sensor apparatus according to yet another embodiment of the present invention. The illustrated fiber-optic sensor apparatus includes an optical transmission system comprising optical fiber 92; laser 94 disposed in light-communicative relationship with fiber 92 at one thereof for coupling light therein; and optical detector 96 disposed in light-communicative relationship with fiber 92 at another end thereof for detecting light propagating therein. The laser-detector combination may be implemented as a transceiver device.

The illustrated fiber-optic sensor apparatus further includes a sensing structure having an absorber-expander element 98 mechanically coupled to a portion of fiber 92 and characterized by a sensitivity to hydrocarbon in at least one of a liquid state and a vapor state. The consequence of such sensitivity is that the sensing structure reactively absorbs hydrocarbon upon the presence thereof (i.e., when brought into intimate contact therewith) and expands in response to the absorption activity. It is through this expansion activity of absorber-expander element 98 that the sensing structure sufficiently engages the fiber body and thereby effectuates an attenuation in light propagation through fiber 92 by causing a reversible deformation (e.g., microbend) in the fiber body. The resulting microbend produces a modulating optical transmittance in fiber 92 that varies in accordance with the presence of hydrocarbon sensed by absorber-expander element 98. The diminished optical transmittance resulting from the fiber microbending is therefore indicative of the concentration of hydrocarbon exposed to and detected by absorber-expander element 98.

The sensing structure is characterized such that its response to the presence of hydrocarbon is defined by a property of reversibility, enabling the sensing structure to be repeatably and substantially restored to an original formation. The restoration process may occur through a variety of hydrocarbon-removal mechanisms, including, but not limited to, diffusion, desorption, and/or evaporation. For example, a thermal applicator (not shown) may be provided to generate and apply thermal energy to absorber-expander element 98 to enable removal of condensate liquid therefrom. The reversibility characteristic permits element absorber-expander element 98 to experience a virtually hysteresis-free and continuous operating cycle (i.e., hydrocarbon detection and absorption, expansion, hydrocarbon removal and contraction) without any degradation in its structural integrity. The sensing structure is preferably formed of a material including dimethyl polysiloxane rubber, which is methyl terminated and has silica and iron oxide fillers. This material is commercially distributed under the name of red silicone rubber and is produced commercially by companies such as General Electric Company. It should be apparent to those skilled in the art that conventional processing and shaping techniques are applicable to such a rubber member so as to permit the construction of an absorber-expander element 98 having any desired dimensional characteristics.

During operation, and in the presence of effluent vapors, absorber-expander element 98 causes a variation in the optical transmittance of fiber 92 due to its hydrocarbon-induced expansion activity that produces a microbend in fiber 92. Optical detector 96 provides a detection signal corresponding to the amount of energy transmitted by laser 94 that is incident upon optical detector 96, hence providing a measure of the change in transmittance attributable to the microbend caused by element 98. This detection signal is also representative of the concentration of hydrocarbon exposed to absorber-expander element 98 and leading to the microbend fiber deformation.

Signal analyzer 100 determines the change in transmittance based on the detected energy level provided by optical detector 96. From this, the concentration of hydrocarbon is determined as a function of the measured attenuation in optical throughput of fiber 92 (i.e., its change in optical transmittance). Processor 38 determines if any adjustments are needed to the vapor recovery flow rate based on the hydrocarbon concentration provided by signal analyzer 100.

In the fiber-optic sensor embodiment described above, the communications channel was configured with an optical fiber having a continuous, uninterrupted length. However, this illustrative implementation should not serve as a limitation thereof, since the present invention may encompass any suitable fiber-optic communication medium including a plurality of distinct optical fiber sections arranged in seriatim, wherein each fiber section is disposed in light-communicative relationship with any adjacent ones of the plural optical fiber sections and is displaced relative to such adjacent optical fiber sections at free ends thereof by a coupling region therebetween. In such configurations, the variation in optical transmittance may occur by developing a microbend in the fiber or by optically misaligning adjacent fiber section.

The illustrated fiber-optic sensor apparatus is described more fully in the aforecited copending application entitled "Vapor Recovery System Utilizing a Fiber-Optic Sensor to Detect Hydrocarbon Emissions," U.S. patent application Ser. No. 09/134,858.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for recovering hydrocarbon vapor effluents from a fuel storage container for use with a fuel delivery system, comprising:

vapor transfer means for generating a vapor drawing action effective in communicating vapor between an inlet port and an outlet port thereof;

sensor means, disposed in effluent-detecting relationship to said fuel storage container, for providing a measurement indicative of the hydrocarbon content in said hydrocarbon effluents; and valve means, disposed in vapor communicating relationship at an inlet port thereof to said fuel storage container and disposed in vapor communicating relationship at an outlet port thereof to the inlet port of said vapor transfer means, for controllably regulating the vapor flow of hydrocarbon effluents to said vapor transfer means in accordance with the hydrocarbon content measurement provided by said sensor means by causing said vapor transfer means to internally circulate the vapor flow of hydrocarbon effluents.

2. The system as recited in claim 1, wherein said sensor means comprises:

oxygen sensor means for sensing an oxygen content within vapors exposed thereto; and analysis means for determining a hydrocarbon content within vapors exposed to said oxygen sensor means on the basis of said sensed oxygen content.

3. The system as recited in claim 1, further comprises:

vapor control means for generating a flow control signal representative of the hydrocarbon content determined by said analysis means; and means for applying the flow control signal provided by said vapor control means to said valve means to effect vapor flow regulation therein.

4. The system as recited in claim 1, wherein said valve means comprises:

an adjustable valve element; and a solenoid assembly for controllably activating said valve element in accordance with the hydrocarbon content measurement provided by said sensor means.

5. The system as recited in claim 4, further comprises:

solenoid control signal means for generating a solenoid control signal representative of the hydrocarbon content determined by said analysis means; and means for coupling the solenoid control signal provided by said solenoid control signal means to said solenoid assembly to effect control thereof.

6. The system as recited in claim 4, wherein said vapor transfer means comprises:

a vapor pump.

* * * * *